US005480069A

United States Patent [19]

Barney et al.

[11] Patent Number: 5,480,069

[45] Date of Patent: Jan. 2, 1996

[54] AEROSOL DISPENSING DEVICE

[75] Inventors: Michael Barney, Leeds; Terry J. Holmes, South Wirral; David Moore, Leicester; Anthony C. Wass, Stamford, all of United Kingdom

[73] Assignee: Chesebrough-Pond's USA Co., Greenwich, Conn.

[21] Appl. No.: 275,209

[22] Filed: Jul. 14, 1994

[30] Foreign Application Priority Data

Jul. 23, 1993 [GB] United Kingdom ..... 9315299
Jul. 23, 1993 [GB] United Kingdom ..... 9315307

[51] Int. Cl.[6] ..... B67D 5/54

[52] U.S. Cl. ..... 222/401

[58] Field of Search ..... 222/401, 402

[56] References Cited

U.S. PATENT DOCUMENTS

| | | | |
|---|---|---|---|
| 2,031,172 | 2/1936 | Maloney | 222/401 X |
| 2,091,735 | 8/1937 | Jepson | 222/401 |
| 2,211,823 | 8/1940 | Jepson | 222/401 |
| 3,907,206 | 9/1975 | Kondo | 239/357 |
| 3,955,720 | 5/1976 | Malone | 222/401 X |
| 3,998,361 | 12/1976 | Arena | 222/402 X |
| 4,492,320 | 1/1985 | Tada | 222/401 X |
| 4,537,334 | 8/1985 | Spengler et al. | 222/401 X |
| 5,180,085 | 1/1993 | Schmid | 222/401 X |
| 5,267,674 | 12/1993 | von Schuckmann | 222/401 X |

FOREIGN PATENT DOCUMENTS

| | | | |
|---|---|---|---|
| 0037496 | 10/1981 | European Pat. Off. . | |
| 0075224 | 3/1983 | European Pat. Off. . | |
| 0230968 | 8/1987 | European Pat. Off. . | |
| 0238611 | 9/1987 | European Pat. Off. . | |
| 0286925 | 10/1988 | European Pat. Off. . | |
| 0482561 | 4/1992 | European Pat. Off. . | |
| 2206743 | 5/1994 | France . | |
| 0338844 | 10/1989 | Japan | 222/401 |
| 7211601 | 8/1972 | Netherlands . | |
| 1217831 | 12/1970 | United Kingdom . | |
| 1582556 | 1/1981 | United Kingdom . | |
| 1598600 | 9/1981 | United Kingdom . | |
| 2106991 | 4/1983 | United Kingdom . | |
| 2181491 | 4/1987 | United Kingdom . | |

*Primary Examiner*—Andres Kashnikow
*Assistant Examiner*—Kenneth Bomberg
*Attorney, Agent, or Firm*—Milton L. Honig

[57] ABSTRACT

The invention provides an aerosol device for the dispensing of a pressurized liquid as an aerosol without the use of a predosed propellant, comprising a liquid storage container, a valve assembly with spray button, a fluid feed for supplying the liquid from the container to the valve, and a pump assembly capable of introducing atmospheric air into the container. The pump assembly has a pressure chamber defined by a wall and having generally open and closed ends, structure for attaching the pump assembly to the container, a piston and one or more one way valves, with the valves located at the generally closed end of the pressure chamber and comprising one or more holes releaseably sealed on the outside of the chamber by one or more elastically deformable members. The central axis of the valve of the aerosol device is not coaxial with the longitudinal axis of the pump assembly.

7 Claims, 8 Drawing Sheets

AEROSOL DISPENSING DEVICE

BACKGROUND OF THE INVENTION

1. Field of the Invention

This invention relates to aerosol dispensing devices. In particular, it relates to aerosol dispensing devices which are able to dispense a spray without the use of a pre-dosed propellant gas.

2. The Related Art

Dispensing devices are known which can be fitted to aerosol dispensing containers, and can be used to dispense as an aerosol the contents of the container without the use of a predosed propellant gas, such as hydrocarbons, chlorofluorocarbons, dimethyl ether, or compressed gasses. Instead, the container is adapted to allow the user to introduce into the container atmospheric air to generate a positive pressure therein, which may in turn be used to dispense the aerosol in conventional fashion. Such systems may conveniently be called "user pressurised" dispensers.

For example, in GB 1 582 556 (Airspray), there is described an aerosol dispensing system which has a conventional type dispensing nozzle located on top of a one way valve, the system being a single self-contained unit which may be attached to a liquid filled container by a screw threaded collar. Co-axial with the nozzle is a circular channel of "U" shaped cross section which can accommodate a hollow piston, which on moving the piston up and down causes air to be introduced past a one way valve and into the container.

A further development of this aerosol dispensing system can be found in EP 238 611 (Airspray). This application describes a system similar to that above, but in which it is possible for air to be introduced into the fluid stream just prior to arriving at the spray button, thus providing what is perceived to be a drier spray in use.

However, these known systems have several disadvantages. Firstly, they tend to have their pumping and dispensing mechanisms located together at the same end of the container. In the case of the Airspray systems described above, the pumping and dispensing mechanisms are located coaxially, and therefore part of the pumping mechanism has to be removed from the container before the spraying mechanism can be accessed. This therefore precludes a smooth transition in use between the pumping and spraying actions, and also acts to prevent one handed use of the container by the user.

Additionally, because of the nature of the system, it has been found that a relatively large force is required by the user to generate a positive pressure in the container. The constraints of the system prevent the fitting to the system of a mechanical system which could lower the force, or at least the perceived force, required by the user to operate the system.

An additional disadvantage of such systems is that it has been found that users of such products are often reluctant to purchase refills for such systems. This may be because the refill pack, when sold, is typically much smaller than the container in which the fluid to be dispensed is stored. This in turn is because the fluid storage part of the dispensing container must not be full in use, but must provide a headspace for the dispensing unit to function effectively. This therefore means that the user must manually decant the fluid into the original fluid container, or alternatively the refill liquid can be sold to the consumer in a partly full container, which is the same size as the original. Neither situation is optimum for the user.

A further disadvantage of the Airspray systems described above is that they require a relatively large pressure, typically 2–3 bar, to be introduced into the container, and this must be introduced via a valve which is located adjacent the spraying means. This large pressure is the valve opening force, and is in part due to the fact that the device requires a relatively large headspace to operate, as described above.

The constraints this puts on the overall design of the container have meant that in use the user has to deliver a quite significant force to the container in a manner which, from an ergonomic viewpoint, is not particularly efficient, in order to generate the necessary internal pressure for aerosol dispensing. This pressurising motion is not a particularly convenient operation for the user to deliver, and usually requires two-handed operation of the device.

Many of the disadvantages of these known user pressurized systems, for example those described above, are disadvantages which are inherent from the type and configuration of the pressurization unit, particularly the pressurization unit described in the Airspray patent applications. In particular, these problems arise because of the constraints on pack design imposed by having the aerosol dispensing nozzle and air inlet valves collocated in the same area of the device. The problem is particularly acute with the Airspray pressurization units, because the dispensing nozzle and air inlet configuration are coaxial.

The problem is also made worse because the design of the Airspray pressurization unit requires in practice that the whole volume of the aerosol container, which is typically fairly large, be raised to an elevated pressure in use. This in turn provides important and costly restraints on the design and manufacture of the aerosol apparatus.

It is an object of the invention to provide a user-pressurised device which has improved ease and simplicity of use for the user, in terms of the ease of pressurization of the device, ease of dispensing of the aerosol, and ease of refillability.

It is a further object of the invention to provide a user pressurised aerosol device which facilitates single handed pressurisation and use by the user, preferably in a simultaneous, or at least rapidly sequential fashion.

It is a further object of the invention to provide a user pressurised aerosol device which has increased ease of use by the user, due to the decreased force, or at least perceived force required by the user in order to generate the internal pressure required for dispensing.

It is a further objective of the invention to provide a user pressurised aerosol dispensing device which may have a reduced size compared to conventional user pressurised devices.

The device according to the invention may conveniently improve on other disadvantages suffered by the prior art.

SUMMARY OF THE INVENTION

Thus, according to the first aspect of the invention, there is provided an aerosol device for the dispensing of a pressurized liquid as an aerosol without the use of a predosed propellant, comprising;

—a container for storing the liquid to be dispensed,

—a valve assembly attached to a spray button head, through which the liquid may be dispensed, —a fluid feed means for supplying the liquid from the container to the valve, —a pump assembly which is capable of introducing atmospheric air into the container to generate a positive pressure therein, the pump assembly comprising a pressure chamber defined by a wall portion and having a generally open end and a generally closed end, means for attaching the pump assembly to the container, a piston located in the pressure chamber, and one or more one way valves, wherein the valve assembly is not coaxial with the pump assembly.

More specifically, and in a further aspect of the invention, the pump assembly, which also functions as an aerosol pressurization unit, preferably comprises a pressure chamber defined by a wall portion, the pressure chamber having a generally open end and a generally closed end, means for attaching the pressure chamber to the dispenser from which the fluid is to be dispensed, a piston head located at the generally open end of the pressure chamber which engages the wall portion of the pressure chamber in a slidable and substantially airtight manner, the piston head being movable towards the generally closed end of the pressure chamber, and one or more one way valves located at the substantially closed end of the pressure chamber.

Conveniently the one or more one way valves comprise at least one orifice located in the generally closed end of the pressure chamber, which are releasably sealed on the outside of the pressure chamber.

In a further preferred embodiment of the invention, the one or more one way valves are located at the generally closed end of the pressure chamber, and comprise at least one hole at the generally closed end of the pressure chamber, releaseably sealed by one or more elastically deformable members (for example a washer) located on the outer surface of the pressure chamber.

Optionally, the piston head may have attached thereto a sealing ring which wipes against the inner surface of the pressure chamber, to improve the seal obtained between the pressure chamber and the piston head.

The piston head, which is located at the generally open end of the pressure chamber, may be caused to move towards the generally closed end of the pressure chamber by manual pressure of the user. Conveniently the return action of the piston head, to return it to its original position, may be caused by a return spring located within the pressure chamber. Conveniently, the wall portion of the pressure chamber is substantially cylindrical.

In a simple embodiment of the invention, the fluid feed means may comprise a conventional flexible diptube.

In a further embodiment of the invention, the longitudinal axis of the pump assembly (ie that axis along which the reciprocal motion of the piston occurs in use) is located non-parallel to the direction from which the valve assembly and spray button head emanate from the container (ie the central axis of the valve); preferably the longitudinal axis of the pump assembly is substantially perpendicular to the central axis of the valve.

Preferably, the pump assembly is located generally in the middle of the device, between the fluid storage container and the spray button. If the device has some or all of the preferred features described above, these may contribute to making the device more ergonomically suitable for single-handed operation and use, including single handed pressurisation and spraying.

In some embodiments of the invention, the fluid feed means may be constructed of several portions. It may simply comprise a length of standard flexible diptube to connect the valve and the pump assembly. However, in a preferred embodiment of the invention, part of the fluid feed means may be actually integrally moulded in the outer wall of the pump assembly, thereby to provide a rigid fluid feed channel which runs around the periphery of the pump assembly. Attached to the other end of the fluid feed channel may be a second length of diptube, which runs from there to the fluid storage container, thereby completing the fluid communication link between the fluid storage container and the valve. The fluid feed means may optionally also include a separate air pressure equalisation channel, to help equalize air pressure in all parts of the dispenser during use.

It should be noted that it is a highly preferred embodiment of the dispenser to be able to provide a positive pressure both above fluid stored in the dispenser to provide the appropriate pressure to dispense fluid, and also in the vicinity of the aerosol valve assembly. The latter is preferred as it enables the valve assembly to be one which provides a so-called "dry spray", in which pressurized air is mixed with fluid in the valve assembly prior to dispensing. To provide such a spray however requires the valve assembly to incorporate the appropriate hardware, which is known and conventional in the art.

This construction of fluid feed means has the advantage that the lengths of conventional flexible diptube used may be kept relatively short and relatively straight. Hence, the fluid feed from the fluid storage container to the valve has been found to be relatively consistent, with minimal blockage caused. Such blockage may be a particular problem when attempting to spray fluids which are suspensions of solid particles in a liquid.

Such a fluid feed arrangement has been found to be advantageous over simply using a single length of conventional flexible diptube as a fluid feed system in certain embodiments of the device according to the invention, since in certain embodiments the pump assembly may be located between the valve and the fluid storage container. As a result, any fluid feed system needs to "pass around" the pump assembly.

If conventional flexible diptube is used on its own for passing fluid the entire distance between the fluid storage container and the valve, the flexible diptube will invariably need to execute one or more fairly substantial "bends" to pass around the pump assembly and will also have an increased tendency to kink. It is these large bends in the diptube that can result in problems in later utilisation of the device. In particular, they may lead to restrictions in the diptube, thereby causing the device not to operate properly.

A further advantage of using the type of fluid feed system described above is that it may enable the device to be shorter than would be possible if the device utilised a conventional flexible diptube. This is because to overcome the problem described above, whereby excessive bending in the diptube can cause restrictions and diptube blockage, it may be necessary to make the device relatively tall, and hence the bends in the diptube relatively gentle, to minimise the problem. Use of the fluid feed system described above minimises this problem.

Yet a further advantage of such a fluid feed means comes about because the configurations of device possible with the preferred fluid feed means as described may be better at preventing splashing of the fluid to be sprayed, after for example when the product has been manufactured, and when it is in transit. If the fluid contained in the apparatus is a solution, any fluid splashed may land on the fine vapour phase taps routinely found in a conventional aerosol valve. When the solvent evaporates, any solution left may crystallize in the vapour phase taps, and prevent the device from spraying properly.

In yet a further preferred embodiment of the invention, the piston of the pump assembly may be adapted to be fitted with an actuating member which may be used to facilitate the pumping action which is applied to the piston. In a highly preferred embodiment, this actuating member may conveniently take the form of the protective cap which may be used to shield the actuator of the device as used in everyday life, and in use will attach to the pump assembly, to facilitate pressure generation within the container. Indeed it will readily be appreciated by the skilled man that such a way of facilitating this pumping action of the piston may not be limited to use in the exact embodiment of pump assembly described and claimed.

As such, according to a further embodiment of the invention, there is provided an aerosol device for the dispensing of a liquid under pressure as an aerosol without the use of a predosed propellant, comprising a container for storing the liquid to be dispensed, a valve assembly and spray button head through which the liquid is to be dispensed, a fluid feed means for supplying the liquid to be sprayed from the container to the nozzle, a pump assembly for introducing atmospheric air into the container, and a protective cap for shielding the spray button head, characterised in that the protective cap is adapted to attach to the pump assembly to assist in the operation of introducing atmospheric air into the container.

Conveniently in this embodiment the central axis of the valve assembly is not coaxial with, and preferably may be substantially perpendicular to, the longitudinal axis of the pump assembly.

Alternatively, and in a further preferred embodiment of the invention which the skilled man may likewise recognise is not limited in its utility to the exact configuration of pump assembly described and claimed, the actuating member may take the form of a member which extends from the casing of the device in use, but when not in use may be parked away in the casing and retained there awaiting further use.

As such, according to a further embodiment of the invention, there is provided an aerosol device for the dispensing of a liquid under pressure as an aerosol without the use of a predosed propellant, comprising a container for storing the liquid to be dispensed, a valve assembly and spray button head through which the liquid is to be dispensed, a fluid feed means for supplying the liquid to be sprayed from the container to the nozzle, and a pump assembly for introducing atmospheric air into the container, characterised in that the device additionally comprises an actuating member attached to the pump assembly which in use extends from the container and facilitates the introduction of atmospheric air into the container, but when not in use may be parked away in the container such that it is substantially flush with the container.

Likewise in this embodiment the central axis of the valve assembly is not coaxial with, and preferably may be substantially perpendicular to, the longitudinal axis of the pump assembly.

In a further preferred form of the invention, the device may be designed so as to be conveniently refillable, and as such the fluid may be contained in a separate portion of the container which is readily detachable from the main body of the container (for example being retained by a screw thread, a bayonet fitting or a simple snap fitting), and may be easily refilled or replaced.

Conveniently, the device may be manufactured from plastics materials, for example injection moulded or injection blown polypropylene. In particular, and in contrast to some of the conventional user pressurised devices, the container according to the invention may be specifically designed such that the minimum amount of the container needs to be pressurised in operation. This may be found to provide cost advantages for manufacture of the container, in particular enabling the container to be manufactured more compactly. In certain preferred embodiments it may therefore be desirable to cover the essential components of the container with a moulded cosmetic shell, which could be manufactured independently of the functional requirements of the container, and could therefore be used to give the container whatever visual appearance or shape was required.

In a preferred aspect of the invention, the means for attaching the pump assembly to the container is located on the outer surface of the wall portion of the pressure chamber, the inner surface of the wall portion being that which generally defines the boundaries of the pressure chamber.

For simplicity of manufacture and also for cost reasons, the one way valves located at the generally closed end of the pressure chamber may comprise at least one hole located in the wall portion of the pressure chamber, which are releasably sealed on the outside of the chamber by one or more elastically deformable members. The one or more holes may be located towards the generally closed end of the pressure chamber, and conveniently in the end wall of the pressure chamber. In a simple form they may take the form of one or more holes located in the generally closed end wall of the pressurization unit, the holes being arranged in a circular formation. A rubber washer may cover these holes, and be anchored in the centre of the formation, the number of holes being optimised according to the required throughput of the unit. Typically the unit may have 4 or 6 holes arranged in circular formation.

In devices according to the invention the pressurization unit may conveniently be located in the dispensing device in a position remote from the dispensing nozzle of the device. Indeed it has been found to be an advantage of devices according to the invention that the pressurization unit may be located relatively remote from the dispensing nozzle, in particular not coaxial with the dispensing nozzle.

It is by this relatively remote location from the dispensing nozzle that various advantages to the user derive, for example improved ease of use, and typically one handed operation in terms of pressurization and spraying of the assembled device.

BRIEF DESCRIPTION OF THE DRAWING

The invention will therefore now be described by way of example only, with reference to the accompanying drawings, in which.

DETAILED DESCRIPTION

Figure 1:
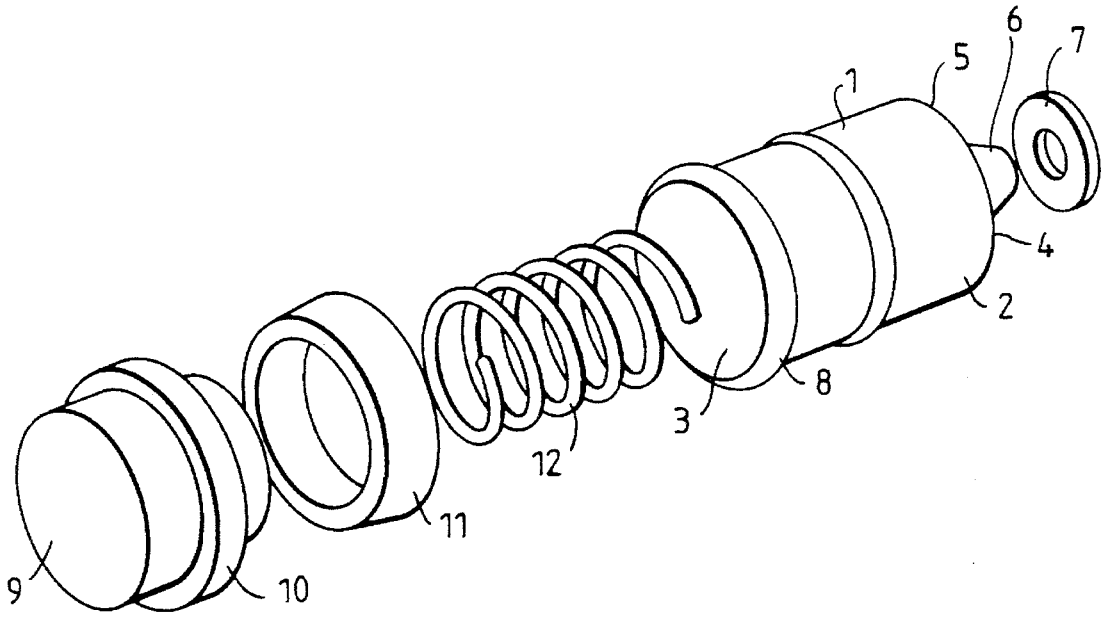
FIG. 1 shows an exploded schematic perspective view of a pump assembly that may be used in an aerosol dispenser according to the invention.

Referring to FIG. 1, there is shown an exploded view of a pump assembly which may be used in an aerosol dispensing device according to the invention, comprising a pressurization unit 1 having a tubular shaped pressure chamber 2, which has a generally open end 3 and a generally closed end 4. Pressure chamber 2 is manufactured from injection moulded plastics materials.

Moulded into generally closed end 4 are four orifices 5 (not shown), which are arranged in circular formation about the central longitudinal axis of pressurization unit 1, and equally spaced from each other. Protruding from the centre of the circular formation of the orifices on the outside of pressure chamber 2 is retention piece 6, which is integrally moulded with the pressurization unit 1. Retention piece 6 acts to retain rubber washer 7 tightly over orifices 5, in the absence of a positive pressure in pressure chamber 2. On the generation of a positive pressure therein, however, washer 7 can elastically deform to allow the passage of air from pressure chamber 2 via orifices 5.

Pressurization unit 1 may be attached to the aerosol dispensing device via appropriate means incorporated into integrally moulded rim 8. These may be for example a screw thread moulded into rim 8, or a surface adapted for ultrasonic welding to a receiving portion on the dispensing unit. In this embodiment the attachment means for attaching the pressurization unit to the dispensing device comprises cooperating snap fitting (not shown) means moulded onto the surface of rim 8, which allow the pressurization unit to be snap fitted into position on the dispenser and peened to secure it.

The pressurization unit 1 additionally comprises a piston head 9, which is generally located within pressure chamber 2. Piston head 9 is of tubular construction with solid end walls, and has fitted an additional wiping portion 10 which facilitates a substantially airtight seal with the sidewalls of pressure chamber 2 during the passage of piston head 9 towards generally closed end 4, but is shaped so as to permit atmospheric air to pass it and enter into pressure chamber 2 on the return stroke. Wiping portion 10 also doubles up to act as a retention means, allowing piston head 9 to be retained in the pressure chamber 2 by sealing collar 11 which attaches to rim 8, (though in FIG. 1 piston head 9 is shown the other side of sealing collar 11 to where it is when the pressurization unit is assembled).

When assembled, piston head 9 is biased towards the open end 3 of piston chamber 2 by the action of helical return spring 12, located inside pressure chamber 2. Return spring 12 retains the piston head 9 in this position by acting on the end surface of piston head 9 and generally closed end 4.

In use, the pressurization unit 1 may be attached to a suitable dispensing dispenser, such as a user pressurized aerosol dispenser, by suitable means. A positive pressure of atmospheric air may be introduced into the dispenser by manually pushing piston head 9 repeatedly into pressure chamber 2 towards generally closed end 4. This causes air to be pushed through orifices 5 and past washer 7, into the dispenser. The one-way nature of the valve involving washer 7 however prevents a back flow of air into pressure chamber 2.

On manually releasing cylinder head 9, head 9 is caused to return to its original position by the action of return spring 12. Air may then seep past wiping portion 10 and into pressure chamber 2. Repetition of the action, typically 5–15 times, will may cause sufficient air to be introduced into the dispenser to enable satisfactory dispensing of the spray.

Figure 2:
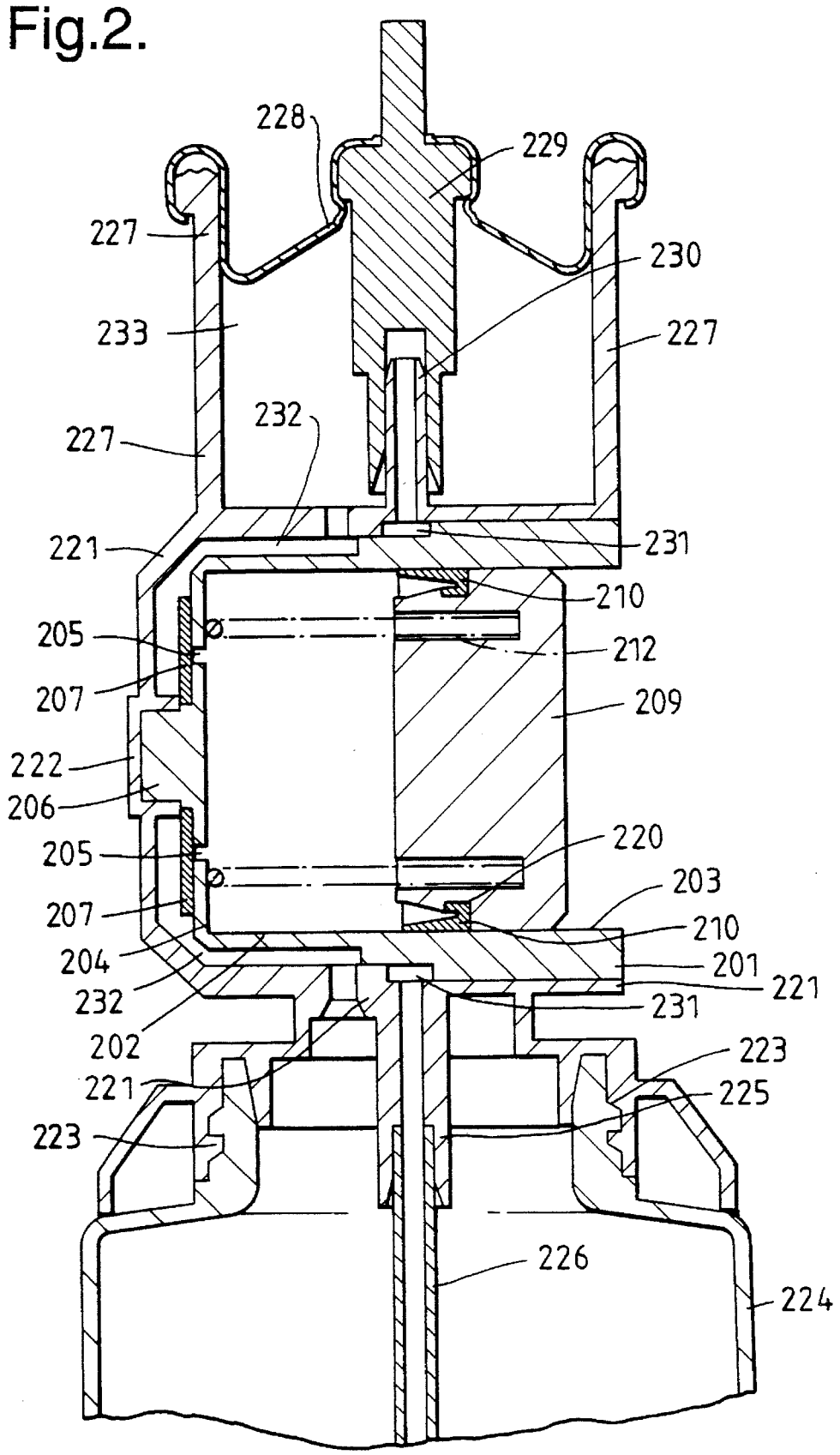
FIG. 2 shows a cross section of part of an aerosol dispenser according to the invention utilizing a similar pump assembly to that shown in FIG. 1.

FIG. 2 shows a cross-sectional view of a pressurization unit similar to that shown in FIG. 1, in situ in an aerosol dispenser.

In this embodiment, the pressurization unit 201 has a tubular shaped pressure chamber 202 with a generally open end 203 and a generally closed end 204, with six orifices 205 being located in the generally closed end 204. The pressure chamber portion of the pressurization unit 201 is conveniently integrally moulded.

Also integrally moulded with pressure chamber 202 is retention piece 206, which helps to retain rubber washer 207 over orifices 205, in the absence of a positive pressure in pressure chamber 202. On the generation of a positive pressure therein, however, washer 207 elastically deforms to allow the passage of air from pressure chamber 202 past washer 207.

Pressure unit 201 additionally comprises a piston head 209, which is generally located within pressure chamber 202. Piston head 209 is of tubular construction with solid end walls, and has attached to it an additional wiping portion 210, which sits within moulded rim 220 on piston head 209. Wiping portion 210 is shaped so as to maximise its resistance when being caused to slide against the inner wall of pressurization chamber 202 when it is slid towards closed end 204, but to have minimal resistance against the inner wall of pressurization chamber 202 when it is caused to slide back towards open end 203.

It is during the sliding action towards open end 203 that it is possible for atmospheric air to seep past wiping portion 210 into pressure chamber 202, thereby replenishing the air therein. Embedded into piston head 209, and resting against the end wall of pressure chamber 202, is return spring 212 (shown by dotted line).

Pressurization unit 201 functions in the same general manner as described above in relation to the unit embodiment of FIG. 1.

The pressurization unit 201 of FIG. 2 is, however, shown in situ, incorporated into a user pressurized aerosol dispenser. Other parts of the aerosol dispenser shown include a casing element 221. Pressurization unit 201 is retained in the dispenser by moulding receiving piece 222, shaped to be of the appropriate dimensions as to grip and retain retention piece 206 of pressurization unit 201, thereby helping retain washer 207 in position. It may be further retained there by peening together receiving piece 222 and retention piece 206 during manufacture.

Casing element 221 may conveniently be made by moulding techniques, and is shaped so as to provide various features required by the aerosol dispenser. For example, integrally moulded into casing element 221 is receiving thread 223, which is capable of releasably retaining container 224 in which fluid to be sprayed is stored. Also integrally moulded into casing element 221 is fluid feed projection 225, which is shaped so as to retain a short length of diptube 226 which extends into any fluid stored in container 224.

On its opposite side, casing element 221 is shaped to extend into a tubular body portion 227. To this may be attached a valve cup 228, and a conventional aerosol valve assembly 229. Integrally moulded with casing element 221 is a second fluid feed projection 230, which feeds directly into valve assembly 229.

Also integrally moulded into casing element 221 is a fluid feed means, which comprises a fluid supply channel 231 and a separate air pressure equalisation channel 232. Channels 231 and 232 are for convenience formed at the interface between casing element 221 and pressurization unit 201, and may conveniently be formed by moulding into both pieces the appropriate co-operating shapes.

Fluid supply channel 231 provides a continuous path by which fluid may flow from container 224 in which it is stored, via diptube 226 and fluid feed projection 225, through to fluid feed projection 230 and valve assembly 229.

Air pressure equalisation channel 232 provides a path by which air introduced into the device by pressurisation unit 201 can be distributed to both any headspace in container 224 and also headspace 233 in tubular body portion 227. However, it also provides a channel which allows air pressure to equalize between headspace 233 and the headspace in container 224, for example during the spraying procedure.

In use, a positive pressure may be introduced by pressurization unit 201 into the aerosol device by manually pushing piston head 209 into pressure chamber 202. This causes air in pressure chamber 202 to be pushed under pressure through orifices 205 past rubber washer 207, and via air pressure equalisation channels 232 into headspace 233, and any headspace in container 224. This causes a positive pressure to be generated in these areas. The one way nature of the valve involving washer 207 prevents back flow of air into pressure chamber 202.

On manually releasing cylinder head 209, head 209 is caused to return to its original position by the action of return spring 212. Repetition of the action typically 5–15 times causes a sufficient positive pressure to be generated in the apparatus such that by actuation of the valve assembly 229, any fluid stored in the container 224 may be caused to be dispensed as a fine spray.

Figure 3:
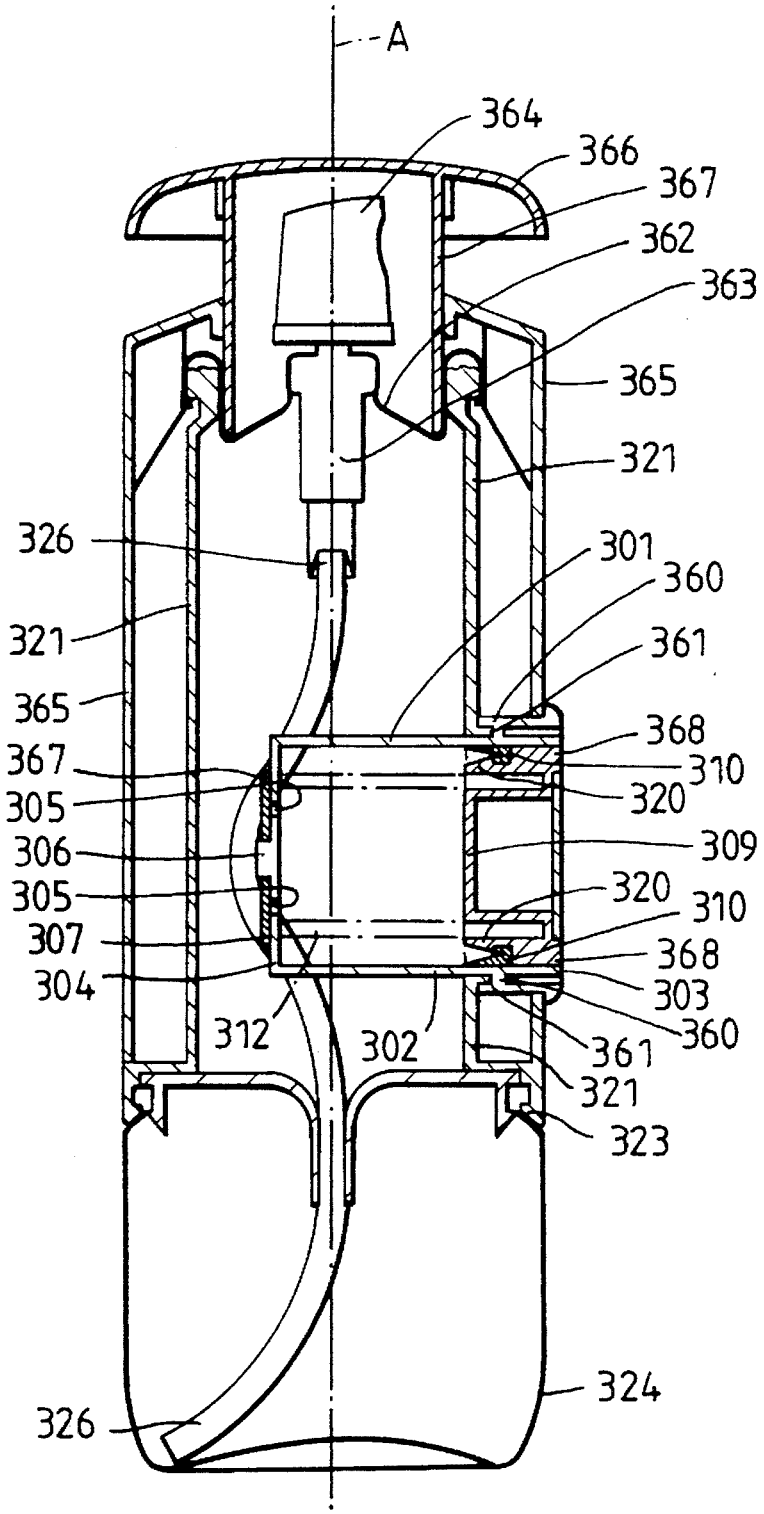
FIG. 3 shows a cross-sectional view of a complete aerosol dispenser according to the invention.

FIG. 3 shows a cross-sectional view of a complete aerosol dispenser according to the invention.

In this embodiment, the pressurization unit 301 has a tubular shaped pressure chamber 302, again with a generally open end 303 and a generally closed end 304. Four orifices 305 are located at the generally closed end 304. Pressure chamber portion 302 of the pressurization unit 301 is integrally moulded from plastics materials.

Integrally moulded with pressure chamber 302 is retention piece 306, which acts to retain rubber washer 307 over orifices 305 in the absence of a positive pressure in pressure chamber 302. On the generation of a positive pressure therein, however, washer 307 elastically deforms to allow the passage of air from pressure chamber 302 past washer 307.

Pressure unit 301 additionally comprises a piston head 309, which is generally located with pressure chamber 302. Piston head 309 is of tubular construction with solid end walls, and has attached to it an additional wiping portion 310, which sits within moulded rim 320 on piston head 309. Wiping portion 310 is shaped so as to maximise its resistance when being caused to slide against the inner wall of pressurization chamber 302 when it is slid towards closed end 304, but to have minimal resistance against the inner wall of pressurization chamber 302 when it is caused to slide back towards open end 303.

It is during the sliding action towards open end 303 that it is possible for atmospheric air to seep past wiping portion 310 into pressure chamber 302, thereby replenishing the air therein. Embedded into piston head 309, and resting against the end wall of pressure chamber 302, is return spring 312 (show by dotted line).

Pressurization unit 301 functions in the same general manner as described above in relation to the unit embodiment of FIG. 1 and FIG. 2.

The pressurization unit 301 of FIG. 3 is, however, shown in situ, incorporated into a user pressurized aerosol dispenser. Other parts of the aerosol dispenser shown include a casing element 321. Pressurization unit 301 is retained in the dispenser by having on the outside of pressure chamber 302 receiving means 360, so as to be able to clip onto edges 361, where it may subsequently be peened.

The pressurization unit in this embodiment has its longitudinal axis (ie. that axis along which the reciprocal motion of the piston head occurs) located perpendicular to the central axis of the valve, (ie. the direction from which the valve assembly and spray button emanate from the container), which is shown as dotted line "A" in FIG. 3.

Casing element 321 may conveniently be made by moulding techniques, and is shaped so as to provide various features required by the aerosol dispenser. For example, integrally moulded into casing element 321 are latch means 323, which is capable of releasably retaining container 324 in which fluid to be sprayed is stored.

Casing element 321 is also shaped in this embodiment to receive a valve cup 362, in which may be located a conventional aerosol valve assembly 363 and spray head 364. The aerosol valve 363 may be of conventional construction and as such may comprise the usual combination of typical features such as mixing chambers, vapour phase taps, break-up units, housings, tailpiece orifices, and so on as are conventionally found in an aerosol valve assembly. These may routinely be varied by those skilled in the art to provide an aerosol valve with the desired spray rate and characteristics.

A typical and also preferred valve assembly which may be used in aerosol dispensers according to the invention is the "Ecosol" valve, manufactured by Precision Valve.

Fluid is supplied to valve assembly 363 by a length of conventional flexible diptube 326, which extends into container 324.

A feature of the dispenser of FIG. 3, and also other dispensers according to the invention, is that it is only the area found generally bounded by casing element 321, valve cup 362 and container 324 which is pressurised. Conveniently this volume is made as small as possible, and in particular the volume inside casing element 321 may be made as small as is necessary to accommodate the fluid feed means and pressurization unit 301.

The device in FIG. 3 has attached to casing element 321 an ornamental shroud 365, separately moulded but attached to casing element 321, to provide the dispenser with whatever overall outside shape and design is required by the user. Shroud 365 is generally tubular, but may be of any shape or cross-section technically or cosmetically preferred by the user. To this end, it may be generally of oval cross-section, or may even be asymmetric in cross-section.

A preferred feature of this embodiment is that the dispenser has a removable protective cap 366, which has a cylindrical body 367, and which is of the appropriate diameter so as to be removably attachable onto a circular groove 368 located on the periphery of piston 309, where it is frictionally retained. Thereafter it may be used as an actuation means, to facilitate the introduction of air into the dispenser.

In use, a positive pressure may be introduced by pressurization unit 301 into the aerosol dispenser by manually pushing piston head 309 into pressure chamber 302. More conveniently this may be done by the user removing protective cap 366, and engaging the cylindrical body 367 of protective cap 366 into the circular groove 368 on piston 309. Thereafter the cap 366 may be used as an actuation means by the user.

The pushing of piston head 309 causes air in pressure chamber 302 to be pushed through orifices 305, past washer 307, and into the volume of the dispenser generally surrounded by casing element 321 and valve cup 362, and also into container 324. A positive pressure is thereby generated in the dispenser. The one way nature of the valve from pressurization unit 301 prevents the back flow of air into pressure chamber 302.

On manually releasing either piston head 309 or preferably cap 366, head 309 is caused to return to its original position by the action of return spring 312. Repetition of the action typically 5–15 times causes a sufficient positive pressure to be generated in the dispenser such that by actuation of the spray head 364, any fluid stored in the container 324 may be caused to be dispensed as a fine aerosol spray simply by pressing spray head 364.

The amount of repetitions of the pumping action required for satisfactory spray dispersion has been indicated as typically being 5–15, but the concise amount will however depend on a number of factors, such as the viscosity of the liquid being dispensed, how full the container is, and so on.

Figure 4:
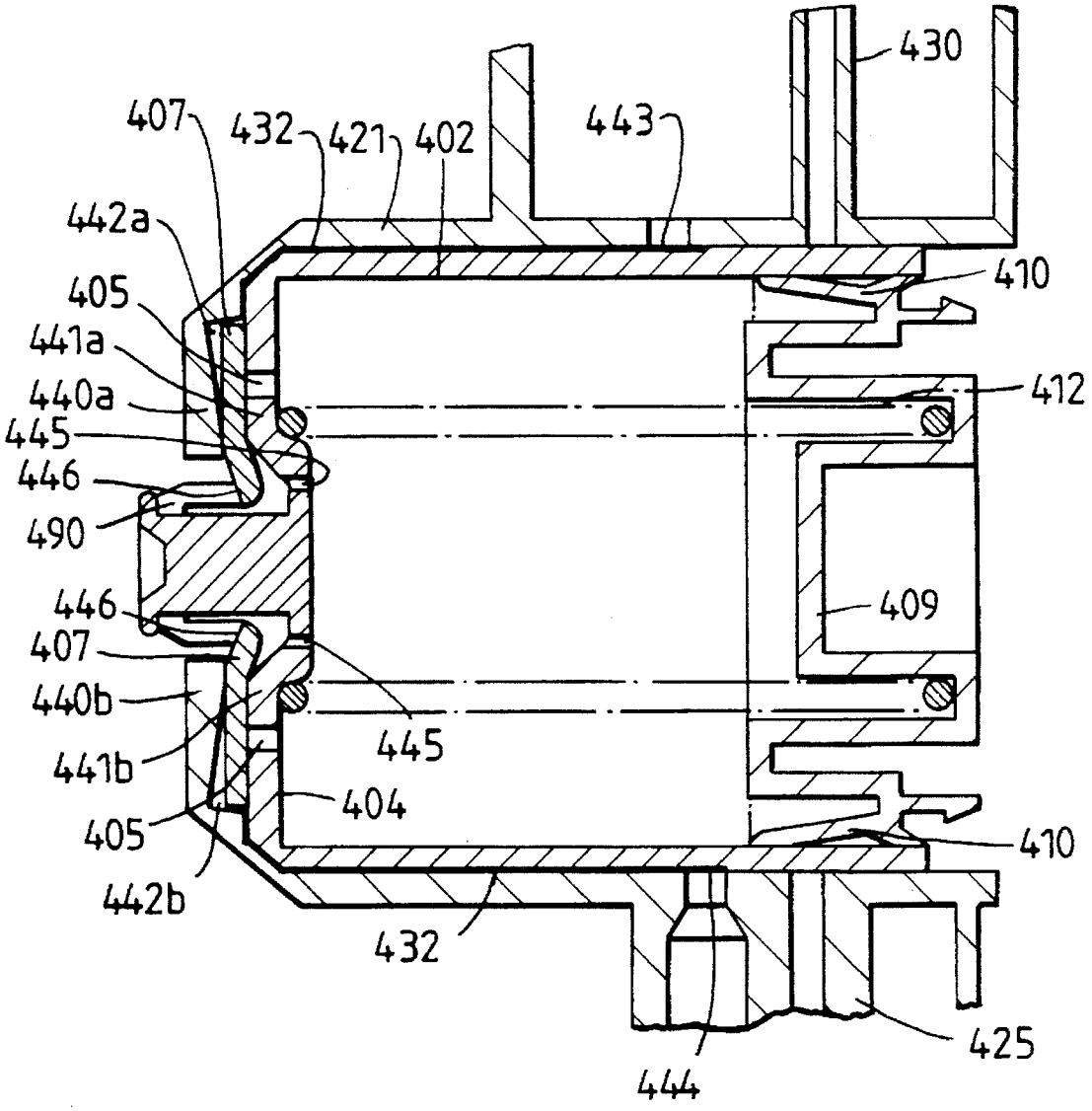
FIG. 4 shows a cross-sectional view of another embodiment of pump assembly according to the invention.

FIG. 4 shows a cross sectional view of an alternative embodiment of pressurisation unit which may be used in aerosol dispensers according to the invention, which incorporates an integral fluid feed means. In this embodiment, which operates in a generally similar fashion to that described in FIG. 2, air may be introduced through orifices 405 and into the body of the aerosol device, past washer 407.

As in the embodiment shown in FIG. 2, the pressure chamber 402 is held generally in close proximity to a casing element 421. However, in this embodiment washer 407 is held in position by portions 440 a, b, and 441 a, b, on casing element 421 and pressure chamber 402 respectively, and by retention clip 490, which also acts to retain pressurization unit 401 in position.

As in previous embodiments, air may be introduced into the device by manual reciprocation of piston head 409 in pressure chamber 402, with piston head 409 being caused to return each time to its normal position by the action of return spring 412. As air pushes past washer 407, casing element 421 has moulded voids 442 a,b into which washer 407 may elastically deform to facilitate the passage of air. Air may then flow along moulded air pressure equalisation channels 432, shown in this drawing as thick dark lines at the interface between casing element 421 and pressure chamber 402, and into the body of the apparatus via orifices 443 and 444. As in previous embodiments which also incorporate the integral fluid feed means, fluid may flow around a fluid supply channel (not shown), which runs around the periphery of pressure chamber 402 and is connected to fluid feed projections 425 and 430.

In this embodiment, the wiping portion 410 on piston head 409 is not included as a separate piece, but instead is integrally moulded with the piston head 409. It is however of the some general shape, and performs the same general function in use on the pressurization stroke, as that described in conjunction with FIG. 2.

However another feature of this embodiment of the invention lies in the way in which air can be replenished into pressure chamber 402. On the return stroke of piston head 409, some air may be drawn into pressure chamber past wiping portion 410. However, at its generally closed end 404, pressure chamber 402 has a set of air inlet valves 445.

On the return stroke of the piston, a pressure less than external pressure may be generated in pressure chamber 402. When this happens, washer 407, which is normally caused to abut in airtight fashion against stops 446, may be caused to deform generally towards air inlet valves 445. This permits atmospheric air to enter from the outside past washer 407, and in through air inlet valves 445 into pressure chamber 402, thus replenishing the air therein.

In this sense, the arrangement of washer 407, stops 446 and air inlet valves 445 acts as a second set of one way valves to allow air into the pressure chamber 402 when the air pressure inside the chamber falls below that outside of the chamber. When the air in the pressure chamber 402 reaches atmospheric pressure, or when the pressure both inside and outside chamber 402 is equal, washer 407 relaxes to take up its normal position adjacent stops 446 and forms a substantially seal therewith.

Figure 5:
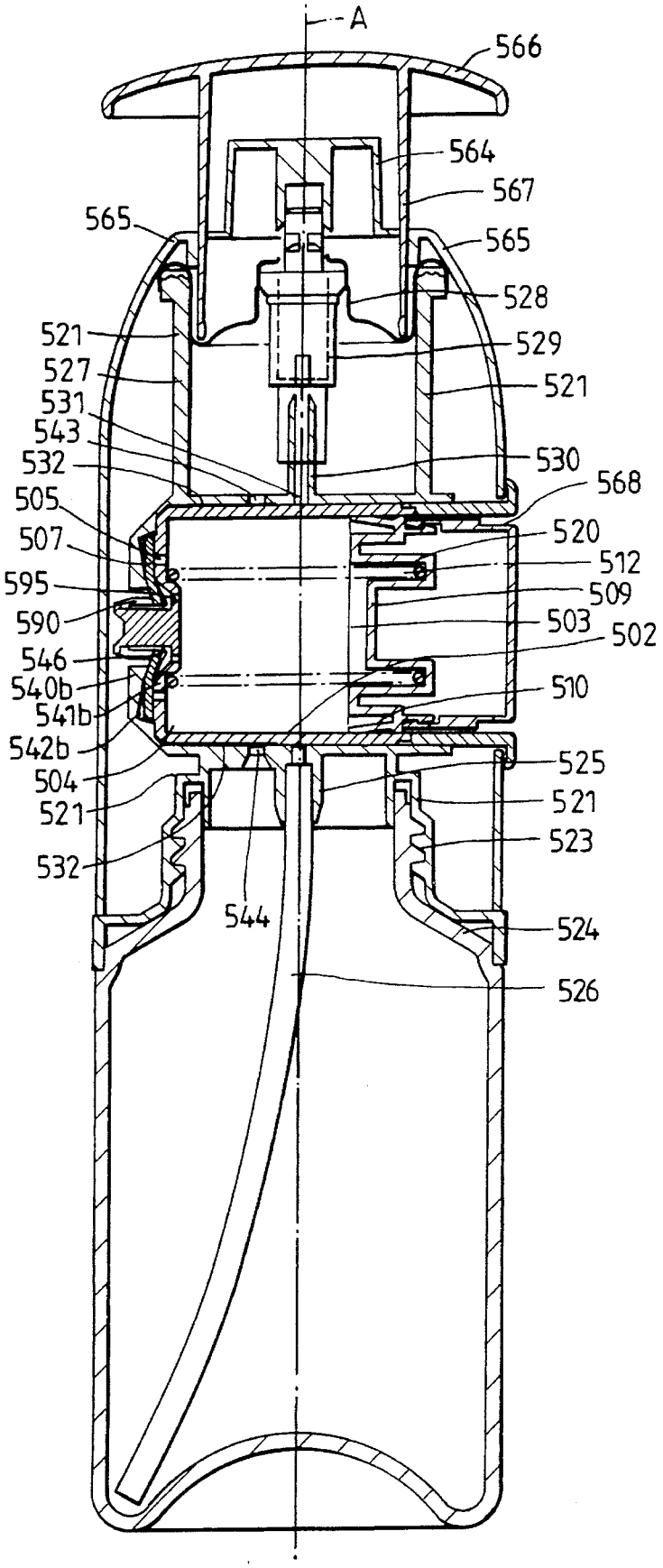
FIG. 5 shows a cross-sectional view of yet another embodiment of aerosol dispenser according to the invention.

FIG. 5 shows an embodiment of dispenser which is generally similar to that shown and described in relation to FIG. 3, except that it has the type of valve on the pressurization unit 501 as shown and described in FIG. 4. That is, located at generally closed end 504 of pressurization unit 501 there are found an extra set of apertures 545, which act as a one way valve and serve to allow some air back into pressurization unit 501 during the return stroke of piston head 509.

A component listing for the embodiment of FIG. 5, which is tubular in cross section and generally functions in the same general manner as previously described, is provided below;

501—Pressurization unit
502—Pressure chamber
503—Generally open end
504—Generally closed end
505—Orifices
507—Rubber washer
509—Piston head
510—Wiping portion
512—Helical return spring
520—Moulded slot
521—Casing element
523—Receiving thread
524—Container
525—Fluid feed projection
526—Diptube
527—Tubular body portion
528—Valve cup
529—Valve assembly
530—Fluid feed projection
531—Fluid supply channel
532—Air pressure equalisation channel
**540*b***—Portion (on casing element)
**541*b***—Portion (on pressure chamber)
**542*b***—Moulded void
543—Orifice
544—Orifice

545—One way air inlet valve
546—Stop
564—Spray head
565—Ornamental shroud
566—Protective cap
567—Cylindrical body
568—Cylindrical groove
590—Retention clip.

The incorporation of a second set of one or more one way valves to permit air to flow into the pressure chamber when the pressure therein is less than external pressure, in addition to those one way valves which allow air to pass out of the pump assembly when there is a positive pressure therein, represents a preferred embodiment of pump assembly.

Figure 6:
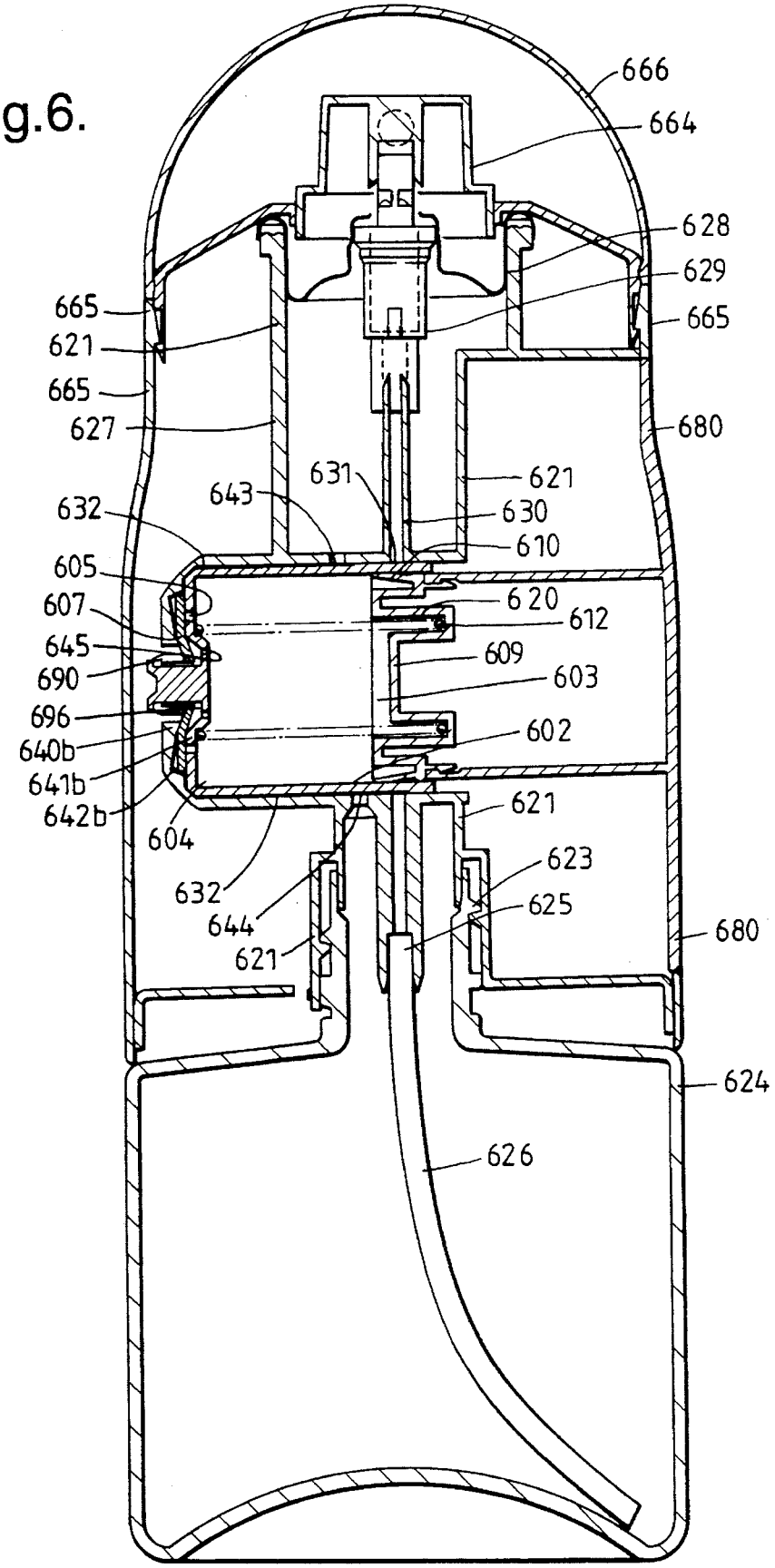
FIG. 6 shows a cross-sectional view of a further embodiment of aerosol dispenser according to the invention.

FIG. 6 shows an alternative embodiment of the dispenser, having the same general internal components and function as that shown in FIG. 5, except that it additionally comprised a separate actuator member 680 which is permanently attached to piston head 609, and which can be used to introduce air into the device. In this embodiment protective cap 666 does not function as an actuating member. The device of FIG. 6 is generally oval in cross section.

A further component listing for the embodiment of FIG. 6, which generally functions in the same general manner as previously described, is provided below;

601—Pressurization unit
602—Pressure chamber
603—Generally open end
604—Generally closed end
605—Orifices
607—Rubber washer
609—Piston head
610—Wiping portion
612—Helical return spring
620—Moulded slot
621—Casing element
623—Receiving thread
624—Container
625—Fluid feed projection
626—Diptube
627—Tubular body portion
628—Valve cup
629—Valve assembly
630—Fluid feed projection
631—Fluid supply channel
632—Air pressure equalisation channel
**640*b***—Portion (on casing element)
**641*b***—Portion (on pressure chamber)
**642*b***—Moulded void
643—Orifice
644—Orifice
645—One way air inlet valve
646—Stop
664—Spray head
665—Ornamental shroud
666—Protective cap
690—Retention clip.

Figure 7:
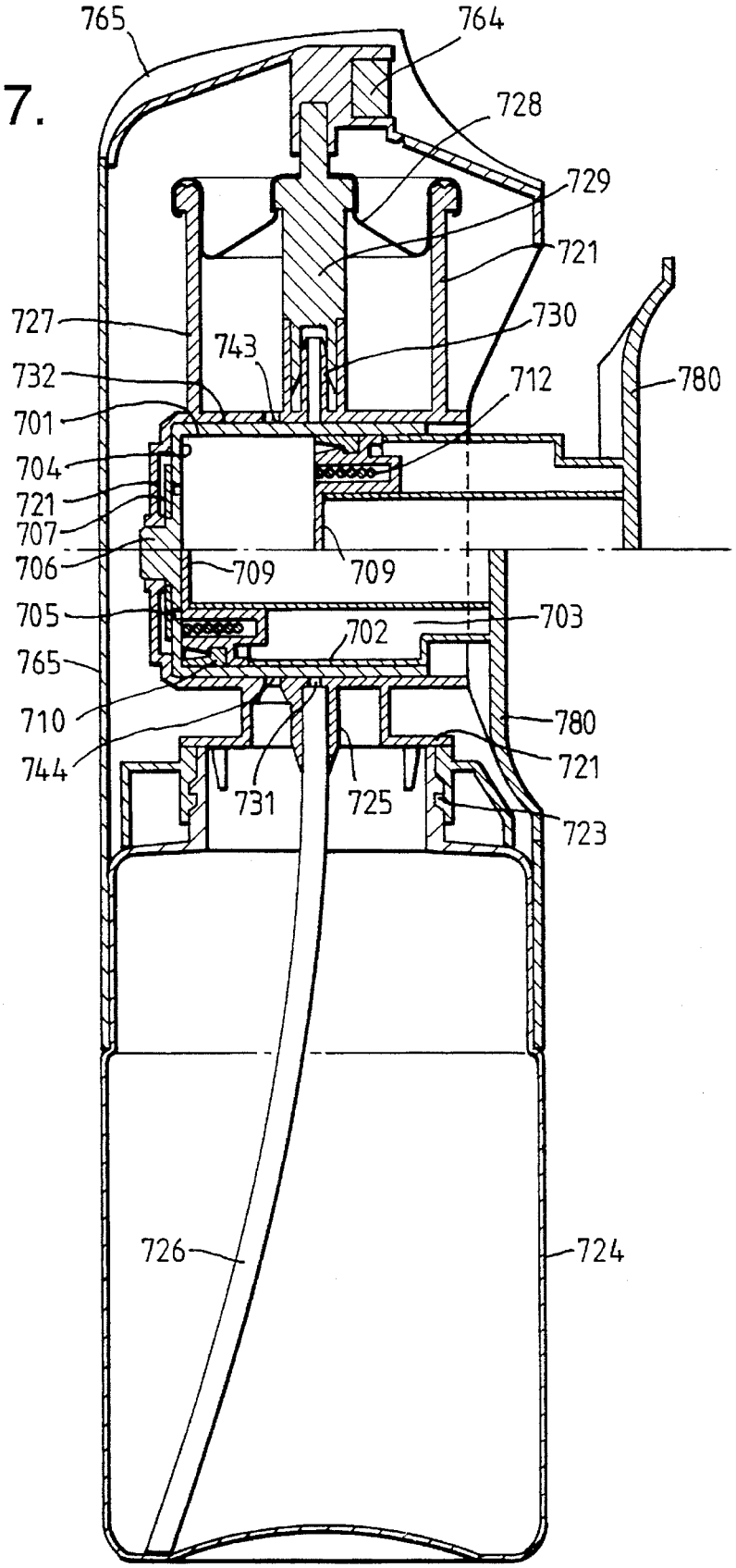
FIG. 7 shows a cross-sectional and partially split view of a further embodiment of aerosol dispenser according to the invention.

FIG. 7 shows a further embodiment of aerosol dispenser according to the invention, which is generally oval in cross section and generally similar in function to those above, but has some differences of substance. In particular, in FIG. 7 the piston head/actuator is shown sectioned, with the upper half of the piston head/actuator being shown in the "rest" position, as in FIG. 5 and 6, and the lower half being shown in the position where the piston head is fully pushed into the pressure chamber. This second lower position also corresponds to the position the actuator member occupies when it is parked away in the dispenser.

When the actuator member is in the position shown in the lower half of FIG. 7, it may be retained there by any convenient locking mechanism, for example being retained at its edges by one or more stops (not shown) located on the dispenser which cooperate with suitable stops on the dispenser casing. However in use, the actuator may be caused to rotate about the central axis of the pressure chamber, typically executing a half circle, which causes the actuator member to disengage from the dispenser. A return spring located in the pressure chamber may then cause the actuator to extend from the dispenser, to a position where it may readily be used by the user to facilitate the pressurisation of the device.

When the device is sufficiently pressurised, the actuator member may be parked away again in the device simply by pushing it into the device as far as it will go, and twisting it again about the central axis of the pressure chamber, but this time in the opposite direction. This will cause the actuator member to re-engage the stops on the dispenser, thereby returning the actuator member to its parked away position.

The embodiment of pressurization unit shown in FIG. 7 is that generally shown and described in conjunction with FIG. 2, and as such does not have the one way air inlet valves to facilitate the return of air to the pressure chamber after the compression stroke of pressurisation. This is instead achieved by air seeping back past the wiping means attached to the piston head.

A further component listing for the embodiment of FIG. 7, which generally functions in the same general manner as previously described, is provided below;

701—Pressurization unit
702—Pressure chamber
703—Generally open end
704—Generally closed end
705—Orifices
706—Retention piece
707—Rubber washer
709—Piston head
710—Wiping portion
712—Helical return spring
721—Casing element
723—Receiving thread
724—Container
725—Fluid feed projection
726—Diptube
727—Tubular body portion
728—Valve cup
729—Valve assembly
730—Fluid feed projection
731—Fluid supply channel
732—Air pressure equalisation channel
743—Orifice

744—Orifice

764—Spray head

765—Ornamental shroud

780—Actuation member

Figure 8:
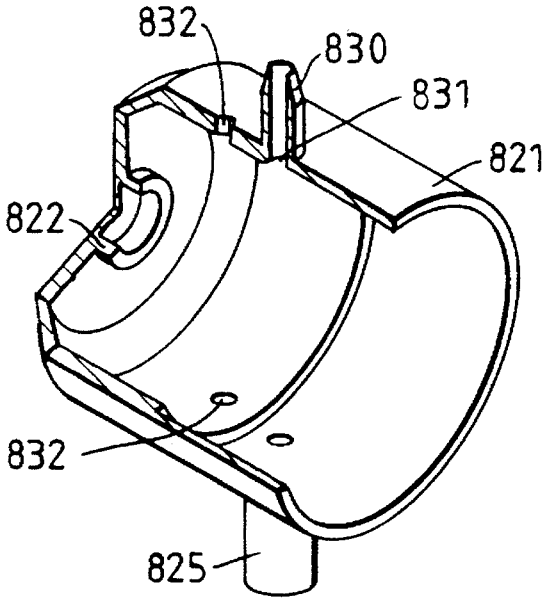
FIG. 8 shows a schematic exploded view partially in cross-section of a pump assembly which may be used in aerosol dispensers according to the invention.

FIG. 8 shows a schematic exploded view of the pressure chamber 802, and part of the casing element 821 of the pressurization unit described in relation to FIGS. 4, 5 and 6. In this preferred embodiment of pressurization unit, the unit may actually comprise two preformed moulded portions, one of which essentially comprises the pressure chamber, and the other which fits together with and over the periphery of the pressure chamber. The parts are moulded appropriately at their co-operating surfaces in order to provide the fluid feed means, including the fluid feed channel 831 and the air pressure equalisation channel 832.

Figure 9:
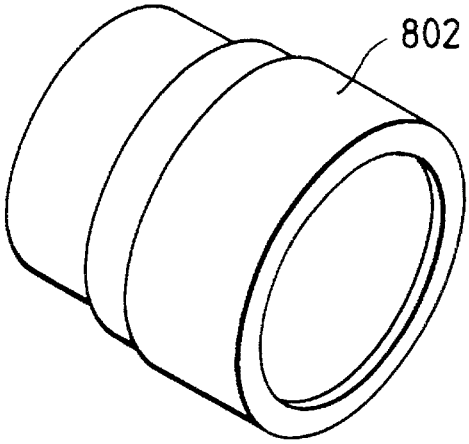
FIG. 9 shows the assembled pump assembly of FIG. 8, but in partial section.
Figure 9:
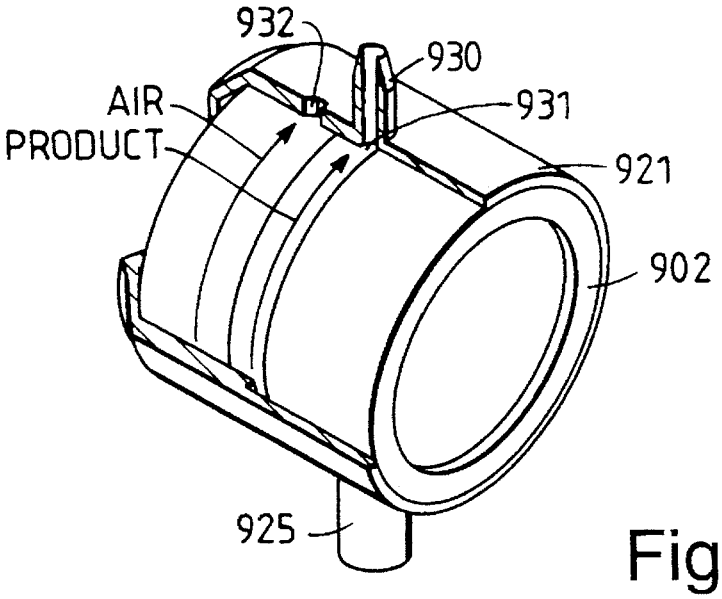

FIG. 9 shows a partially sectioned view of the assembled pressure chamber 902 and casing element 921 of FIG. 8. From FIGS. 8 and 9 it is possible to clearly see the integral fluid feed means of this embodiment of the invention, in particular the air pressure equalisation channel 832/932 and the fluid supply channel 831/931.

We claim:

1. An aerosol device for dispensing of a pressured liquid as an aerosol without use of a pre-dosed propellant, comprising:

(i) a container for storing the pressured liquid to be dispensed;

(ii) a valve assembly arranged along a central axis of said device including a spray button head through which the pressured liquid may be dispensed, the valve assembly communicating with and being downstream from the container;

(iii) a casing interposed between the valve assembly and the container;

(iv) a fluid feed projection for conducting the pressured liquid from the container downstream to the valve assembly, the fluid feed projection being fitted on an upper open end of the container; and (v) a pump assembly arranged along a longitudinal axis down a length thereof, the longitudinal axis not being coaxial with the central axis of the valve assembly, the pump assembly at least partially being surrounded by the casing and capable of introducing atmospheric air into the container to generate a positive pressure therein, the pump assembly comprising:

a pressure chamber defined by a generally open end, a generally closed end, an inner surface and an outer surface;

means for attaching the pump assembly to the container;

a piston located in the pressure chamber;

at least one one-way valve located at the generally closed end of the pressure chamber and having at least one hole releasably sealed by at least one elastically deformable member located on the outer surface of the pressure chamber; and an integral fluid feed means for transferring liquid from the fluid feed projection to the valve assembly, the integral fluid feed means being molded into a portion of the pump assembly and a portion of the casing at their co-operating interface.

2. An aerosol device according to claim 1 further comprising a wiping portion arranged on the piston to contact the inner surface of the pressure chamber, the wiping portion being shaped so as to maximize its resistance when being caused to slide against the inner surface of the pressure chamber towards the closed end and to have minimal resistance against the inner surface of the pressure chamber when caused to slide back towards the open end.

3. An aerosol device according to claim 1, wherein the longitudinal axis of the pump assembly is located substantially perpendicular to the central axis of the valve.

4. An aerosol device according to claim 1, wherein the piston has attached thereto an actuating member.

5. An aerosol device according to claim 1, wherein the integral fluid feed means comprises a fluid feed channel.

6. An aerosol device according to claim 1, wherein the integral fluid feed means comprises an air pressure equalisation channel.

7. An aerosol device for dispensing of a pressured liquid as an aerosol without use of a pre-dosed propellant, comprising:

(i) a container for storing the pressured liquid to be dispensed;

(ii) a valve assembly arranged along a central axis of said device including a spray button head through which the pressured liquid may be dispensed, the valve assembly communicating with and being downstream from the container;

(iii) a casing interposed between the valve assembly and the container;

(iv) a fluid feed projection for conducting the pressured liquid from the container downstream to the valve assembly, the fluid feed projection being fitted on an upper open end of the container; and (v) a pump assembly arranged along a longitudinal axis down a length thereof, the longitudinal axis not being coaxial with the central axis of the valve assembly, the pump assembly at least partially being surrounded by the casing and capable of introducing atmospheric air into the container to generate a positive pressure therein, the pump assembly comprising:

a pressure chamber defined by a generally open end, a generally closed end, an inner surface and an outer surface;

means for attaching the pump assembly to the container;

a piston located in the pressure chamber; and at least one one-way valve located at the generally closed end of the pressure chamber and having at least one hole releasably sealed by at least one elastically deformable member located on the outer surface of the pressure chamber, the at least one one-way valve arranged above the container storing the pressured liquid.

* * * * *